US012486858B1

(12) United States Patent
Lin et al.

(10) Patent No.: US 12,486,858 B1
(45) Date of Patent: Dec. 2, 2025

(54) HIGH AIR PRESSURE FAN

(71) Applicant: SHENZHEN LUANSHENG ELECTRONIC TECHNOLOGY CO., LTD, Shenzhen (CN)

(72) Inventors: Yonggan Lin, Shenzhen (CN); Guoxing Wu, Shenzhen (CN)

(73) Assignee: SHENZHEN LUANSHENG ELECTRONIC TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/014,242

(22) Filed: Jan. 9, 2025

(51) Int. Cl.
*F04D 19/00* (2006.01)
*F04D 29/52* (2006.01)
*F04D 29/54* (2006.01)

(52) U.S. Cl.
CPC ..... *F04D 29/545* (2013.01); *F04D 19/002* (2013.01); *F04D 29/522* (2013.01)

(58) Field of Classification Search
CPC ..... F04D 29/545; F04D 19/002; F04D 29/522
See application file for complete search history.

(56) References Cited

U.S. PATENT DOCUMENTS 7,819,641 B2 * 10/2010 Decker ..... F04D 29/5806 417/370
8,622,695 B2 * 1/2014 Decker ..... F04D 29/541 415/214.1
2011/0255239 A1 * 10/2011 Franz ..... G06F 1/20 361/679.48
2019/0301473 A1 * 10/2019 Kato ..... F04D 29/522
2020/0137966 A1 * 5/2020 Suzuki ..... F04D 29/584

* cited by examiner

*Primary Examiner* — Nathaniel E Wiehe
*Assistant Examiner* — Theodore C Ribadeneyra
(74) *Attorney, Agent, or Firm* — Li & Cai Intellectual Property Office

(57) ABSTRACT

The disclosure relates to the field of fan technologies, and more specifically, to a high air pressure fan. The high air pressure fan includes a boosting air duct housing assembly, an airflow pushing assembly, and a deflection and boosting assembly. Two opposite ends of the boosting air duct housing assembly communicate with each other and are respectively provided with an air inlet and an air outlet. The airflow pushing assembly is arranged inside the boosting air duct housing assembly, and is configured to push air from the air inlet to the air outlet. The deflection and boosting assembly includes a deflection and boosting column arranged inside the boosting air duct housing assembly. The deflection and boosting column cooperates with the boosting air duct housing assembly to enable air pushed by the airflow pushing assembly to be boosted inside the boosting air duct housing assembly.

5 Claims, 6 Drawing Sheets

HIGH AIR PRESSURE FAN

FIELD OF THE DISCLOSURE

This disclosure relates to the field of fan technologies, and more specifically, to a high air pressure fan.

BACKGROUND OF THE DISCLOSURE

A fan is an apparatus used for generating airflow. It turns fan blades to create airflow, so as to bring a cool feeling. The origin of the fan can be traced back to ancient times, but mechanical fans and electric fans in the real sense have only gradually developed in modern times. There are many types of fans, which can be mainly divided into floor fans, desk fans, air circulation fans, ceiling fans, wall fans, air conditioning fans, and bladeless fans according to the use occasions and shape characteristics. These fans have their own characteristics and are suitable for different occasions and needs.

The operating principle of a fan is mainly as follows: An energized coil rotates under force in a magnetic field, and fan blades rotate accordingly, to cut air to form airflow and cause surrounding air to flow, so as to bring a cool feeling. In this process, electrical energy is mainly converted into mechanical energy.

However, to improve the efficiency of blowing and cooling, some existing fans will be equipped with a boosting structure in terms of the internal structure to increase the air speed blown out from the air outlet. The boosting high-speed fans with more complex internal structures have many assembly components, which significantly increases the assembly difficulty.

SUMMARY OF THE DISCLOSURE

The technical problem to be solved by this disclosure is as follows: To improve the efficiency of blowing and cooling, some existing fans will be equipped with a boosting structure in terms of the internal structure to increase the air speed blown out from the air outlet. The boosting high-speed fans with more complex internal structures have many assembly components, which significantly increases the assembly difficulty. In view of the above defects in the prior art, a high air pressure fan is provided.

To solve the foregoing technical problem, the following technical solution is used in the disclosure:

A high air pressure fan is constructed, including: a boosting air duct housing assembly, where two opposite ends of the boosting air duct housing assembly communicate with each other and are respectively provided with an air inlet and an air outlet;

an airflow pushing assembly arranged inside the boosting air duct housing assembly and configured to push air from the air inlet to the air outlet; and a deflection and boosting assembly, including a deflection and boosting column arranged inside the boosting air duct housing assembly, where the deflection and boosting column cooperates with the boosting air duct housing assembly to enable the air pushed by the airflow pushing assembly to be boosted inside the boosting air duct housing assembly.

Optionally, the boosting air duct housing assembly includes a first air duct housing and a second air duct housing detachably connected to one end of the first air duct housing, where a mounting portion is arranged inside the first air duct housing, and an outer wall of the mounting portion is connected to an inner wall of the first air duct housing through a deflection plate.

Optionally, an inner diameter of the second air duct housing gradually decreases from a direction of the air inlet towards the air outlet.

Optionally, the deflection and boosting column is arranged at one end of the mounting portion close to the second air duct housing, and the deflection and boosting column is conical and penetrates into the second air duct housing.

Optionally, the airflow pushing assembly is a fan body, a fan mounting column is arranged at one end of the mounting portion away from the second air duct housing, and the fan body is rotatably connected to the fan mounting column.

Optionally, a first connecting plate is arranged at one end of the first air duct housing, and a first connecting hole and a positioning hole are arranged at each of four corners of the first connecting plate; a second connecting plate is arranged at one end of the second air duct housing close to the first air duct housing, and a positioning pin that can be plugged into the positioning hole and a second connecting hole matching the first connecting hole are arranged at each of four corners of the second connecting plate; and connecting pieces are used to penetrate through the first connecting holes and the second connecting holes for secure connection.

Optionally, a plug-in slot is arranged at one end of the mounting portion close to the second air duct housing; a hollow plug-in column is arranged inside the plug-in slot; and an insertion column configured to be inserted into the hollow plug-in column for connection and an insertion block configured to be inserted into the plug-in slot for connection are arranged at the bottom of the deflection and boosting column.

Optionally, a first wire groove that is connected to one end of the mounting portion away from the second air duct housing is arranged at the bottom of the plug-in slot, a second wire groove that is connected to the outer wall of the mounting portion is arranged on one side of the plug-in slot, and a third wire groove that is connected to an outer wall of the first air duct housing is arranged on the inner wall of the first air duct housing.

Optionally, a wire pressing rod is arranged at the bottom of the deflection and boosting column, and when the deflection and boosting column is installed on the mounting portion, the wire pressing rod is located in the second wire groove and the third wire groove for pressing and fastening wires.

Optionally, a plurality of deflection plates are arranged around the mounting portion, and the wire pressing rod faces any one of the plurality of deflection plates.

The beneficial effects of this disclosure are as follows:

In the disclosure, a boosting air duct housing assembly, an airflow pushing assembly, and a deflection and boosting assembly are arranged; two opposite ends of the boosting air duct housing assembly communicate with each other and are respectively provided with an air inlet and an air outlet; the airflow pushing assembly is arranged inside the boosting air duct housing assembly, and is configured to push air from the air inlet to the air outlet; the deflection and boosting assembly includes a deflection and boosting column arranged inside the boosting air duct housing assembly; and the deflection and boosting column cooperates with the boosting air duct housing assembly to enable air pushed by the airflow pushing assembly to be boosted inside the boosting air duct housing assembly. When the disclosure is used, the airflow pushing assembly can be started first, and the airflow pushing assembly sucks in the air from the air inlet and pushes it towards the air outlet. When the air flows through the deflection and boosting column, the disclosure only requires cooperation between the deflection and boosting column and the boosting air duct housing assembly to effectively compress and accelerate the air in an air duct, thereby increasing the airflow pressure at the air outlet. The deflection and boosting column can also guide the airflow to flow in a specific direction, to reduce airflow turbulence and energy loss, thereby improving heat dissipation efficiency. In addition, the structure in the disclosure is simple and the assembly difficulty is low. It only requires cooperation between the deflection and boosting column and the boosting air duct housing assembly to accelerate the air blown out from the air outlet.

BRIEF DESCRIPTION OF THE DRAWINGS

To provide a clearer explanation of the embodiments of the disclosure or the technical solutions in the prior art, the following will further explain the disclosure with reference to the accompanying drawings and embodiments. The accompanying drawings described below are only some embodiments of the disclosure. For those skilled in the art, other drawings can be obtained based on these drawings without creative efforts.

DESCRIPTIONS OF REFERENCE NUMERALS ARE AS FOLLOWS

Figure 1:
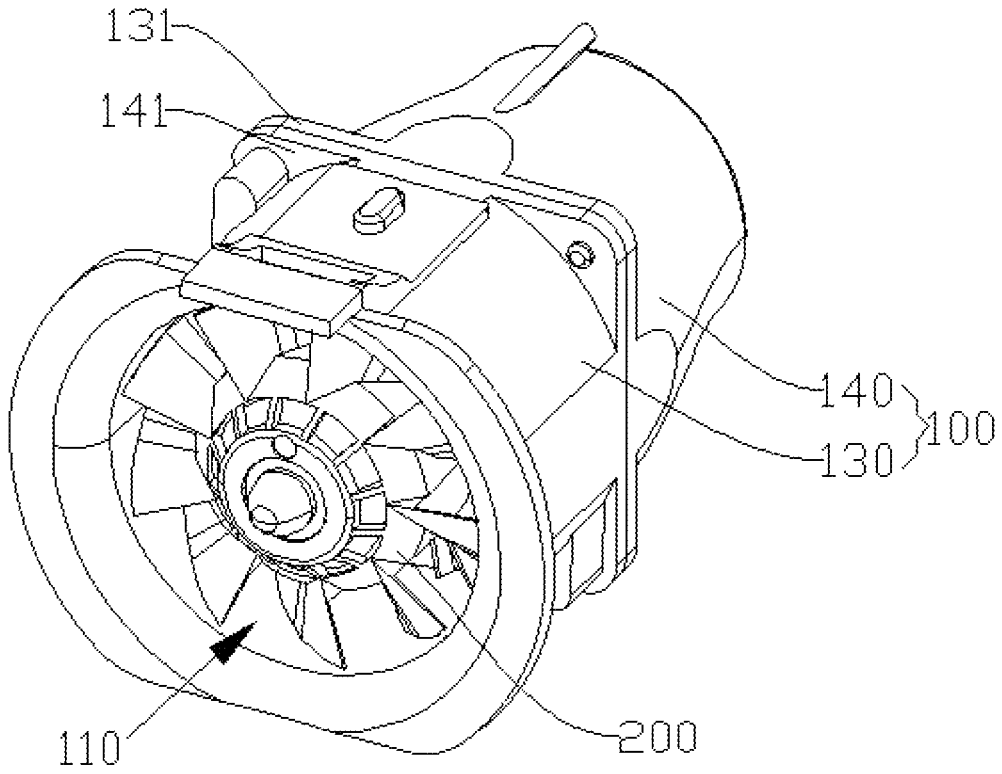
FIG. 1 is an overall axonometric schematic view according to the disclosure.
Figure 2:
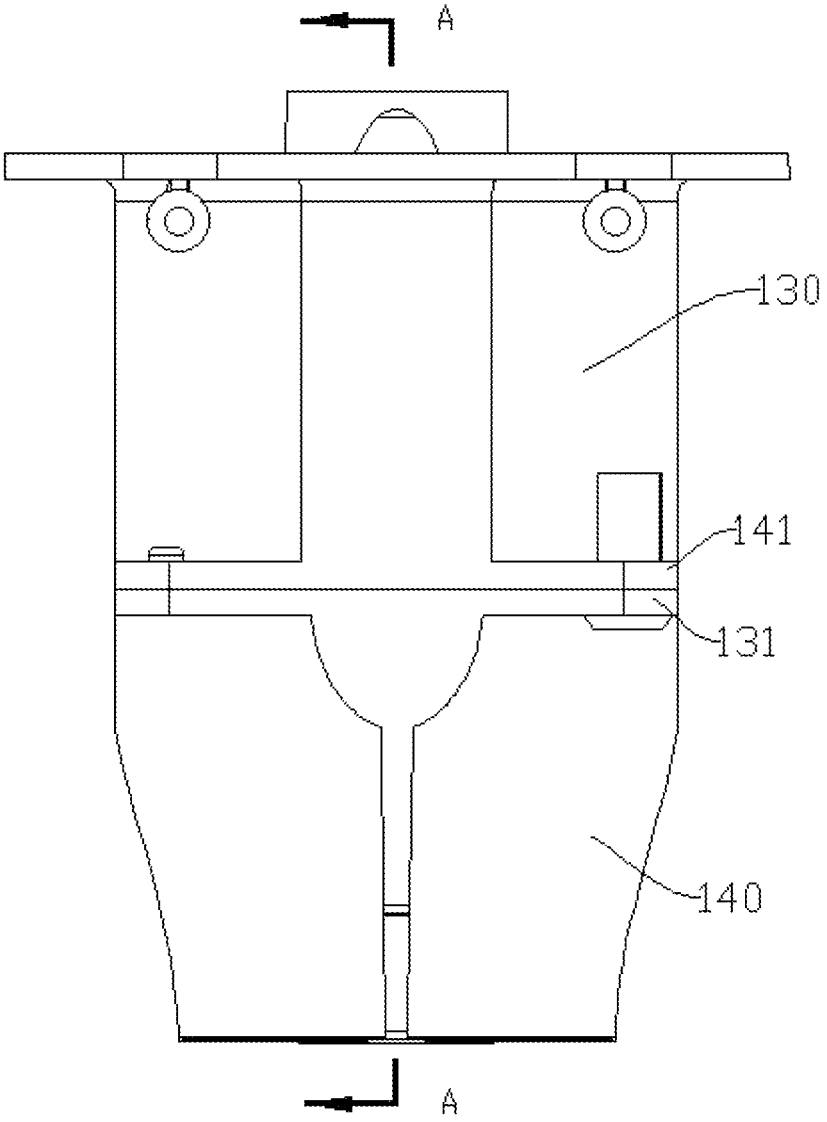
FIG. 2 is an overall side view of an overall side according to the disclosure.
Figure 3:
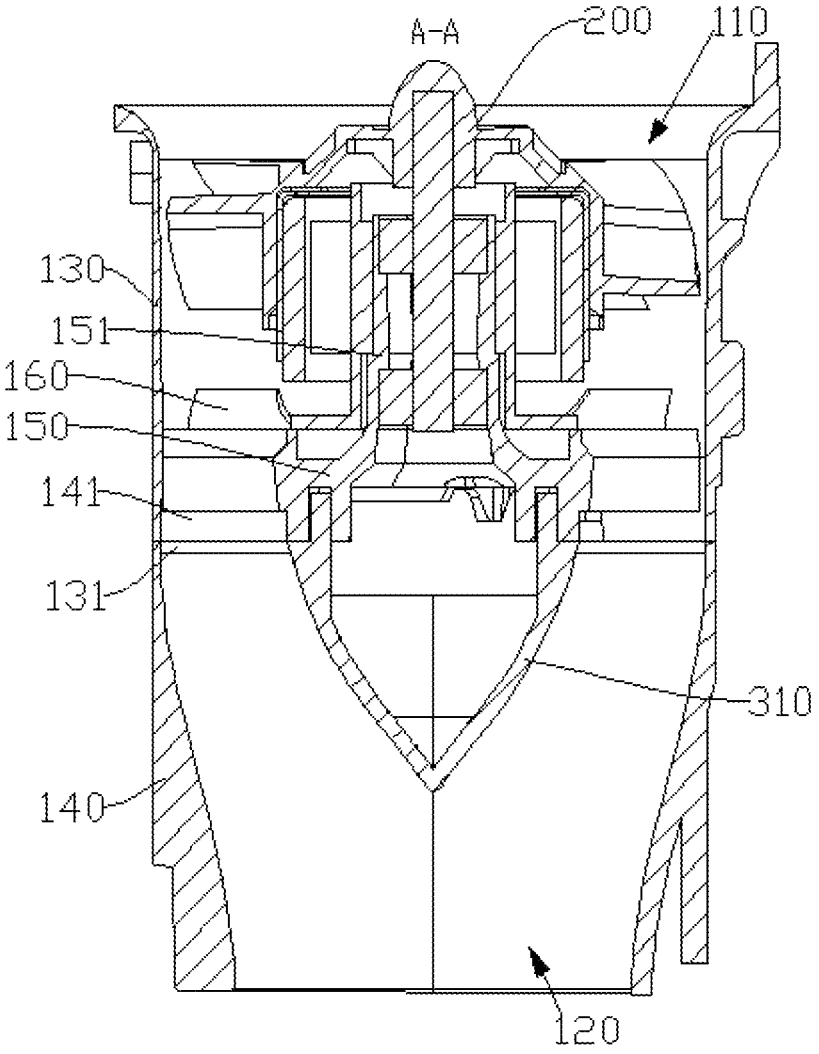
FIG. 3 is a schematic cross-sectional view taken along a line A-A in FIG. 2 according to the disclosure.
Figure 4:
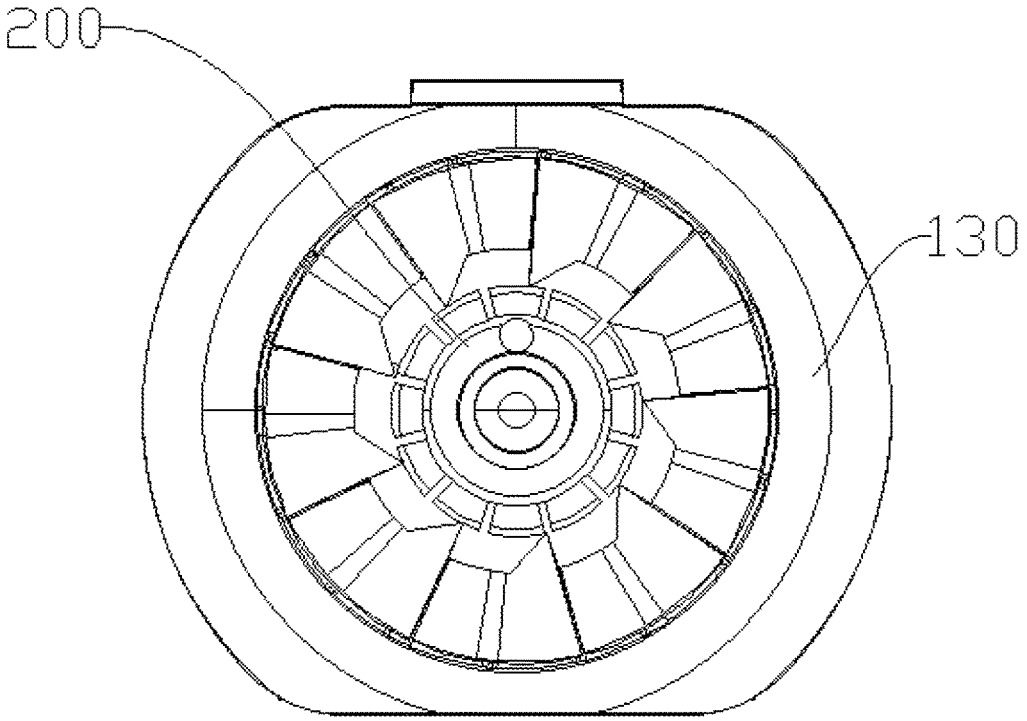
FIG. 4 is an overall front view according to the disclosure.

100: boosting air duct housing assembly; 110: air inlet; 120: air outlet; 130: first air duct housing; 131: first connecting plate; 131.1: first connecting hole; 131.2: positioning hole; 140: second air duct housing; 141: second connecting plate; 141.1: positioning pin; 141.2: second connecting hole; 150: mounting portion; 151: fan mounting column; 152: plug-in slot; 153: hollow plug-in column; 154: first wire groove; 155: second wire groove; 156: third wire groove; 160: deflection plate; 161: flat plate-shaped deflection plate; 162: curved plate-shaped deflection plate;

200: airflow pushing assembly; and

310: deflection and boosting column; 311: insertion column; 312: insertion block; 313: wire pressing rod.

DETAILED DESCRIPTION OF THE EXEMPLARY EMBODIMENTS

To make the objectives, technical solutions, and advantages of the disclosure clearer, the following clearly and completely describes the technical solutions in the disclosure with reference to the accompanying drawings in the disclosure. Apparently, the described embodiments are merely some but not all embodiments of the disclosure. All other embodiments obtained by those of ordinary skill in the art based on the embodiments of the disclosure without creative efforts shall fall within the protection scope of the disclosure.

Embodiments of the disclosure, as shown in FIG. 1 to FIG. 8, relate to a high air pressure fan, including a boosting air duct housing assembly 100, an airflow pushing assembly 200, and a deflection and boosting assembly. Two opposite ends of the boosting air duct housing assembly 100 are connected with an air inlet 110 and an air outlet 120. The airflow pushing assembly 200 is arranged inside the boosting air duct housing assembly 100, and is configured to push air from an air inlet 110 to an air outlet 120. The deflection and boosting assembly includes a deflection and boosting column 310 arranged inside the boosting air duct housing assembly 100. The deflection and boosting column 310 cooperates with the boosting air duct housing assembly 100 to boost air pushed by the airflow pushing assembly 200 inside the boosting air duct housing assembly 100. Further, when the disclosure is used, the airflow pushing assembly 200 can be started first, and the airflow pushing assembly 200 sucks in the air from the air inlet 110 and pushes it towards the air outlet 120. When the air flows through the deflection and boosting column 310, through cooperation between the deflection and boosting column 310 and the boosting air duct housing assembly 100, the air is effectively compressed and accelerated in the air duct, thereby increasing an airflow pressure at the air outlet. The deflection and boosting column 310 can also guide the airflow according to specific requirements, to reduce airflow turbulence and energy loss, thereby improving the heat dissipation efficiency.

In this embodiment, the boosting air duct housing assembly 100 includes a first air duct housing 130 and a second air duct housing 140 detachably connected to one end of the first air duct housing 130. A mounting portion 150 is arranged inside the first air duct housing 130, and an outer wall of the mounting portion 150 is connected to an inner wall of the first air duct housing 130 through a deflection plate 160. Further, an inner diameter of the second air duct housing 140 gradually decreases from a direction of the air inlet 110 towards the air outlet 120. Specifically, the first air duct housing 130 and the second air duct housing 140 are detachably connected, so that the air duct system can be easily assembled and disassembled, thereby facilitating subsequent maintenance, cleaning, and assembly replacement. The outer wall of the mounting portion 150 and the inner wall of the first air duct housing 130 are connected by the deflection plate 160. The deflection plate 160 not only connects the mounting portion 150 with the first air duct housing 130, but also guides the air flow to flow through a flow path in the air duct, to reduce airflow turbulence and energy loss, thereby improving the boosting effect. The first air duct portion in the second air duct housing 140 is close to the air inlet 110, and its inner diameter gradually decreases from the air inlet 110 towards the air outlet 120. The tapered air duct can accelerate the flow of the airflow, increase the pressure and flow rate of the airflow, and further enhance the boosting effect. In some embodiments, there are two types of deflection plates 160: One is a flat plate-shaped deflection plate 161, and the other is a curved plate-shaped deflection plate 162.

Referring to FIG. 4 to FIG. 7, in this embodiment, a deflection and boosting column 310 is arranged at one end of the mounting portion 150 close to the second air duct housing 140. The deflection and boosting column 310 is conical and penetrates into the second air duct housing 140, so that the deflection and boosting column 310 cooperates with the second air duct housing 140 to boost the air. Further, the conical shape of the deflection and boosting column 310 can effectively guide the airflow to flow through the flow path in the air duct, reducing airflow turbulence and energy loss.

Referring to FIG. 4 to FIG. 7, in this embodiment, the airflow pushing assembly is a fan body, and a fan mounting column 151 is arranged at one end of the mounting portion 150 away from the second air duct housing 140. The fan body is rotatably connected to the fan mounting column 151. Further, the fan body is mounted on the fan mounting column 151 to ensure that a rotation axis of the fan is consistent with the airflow path in the air duct system, thereby more effectively pushing the airflow to flow in the air duct and achieving a boosting effect.

Figure 5:
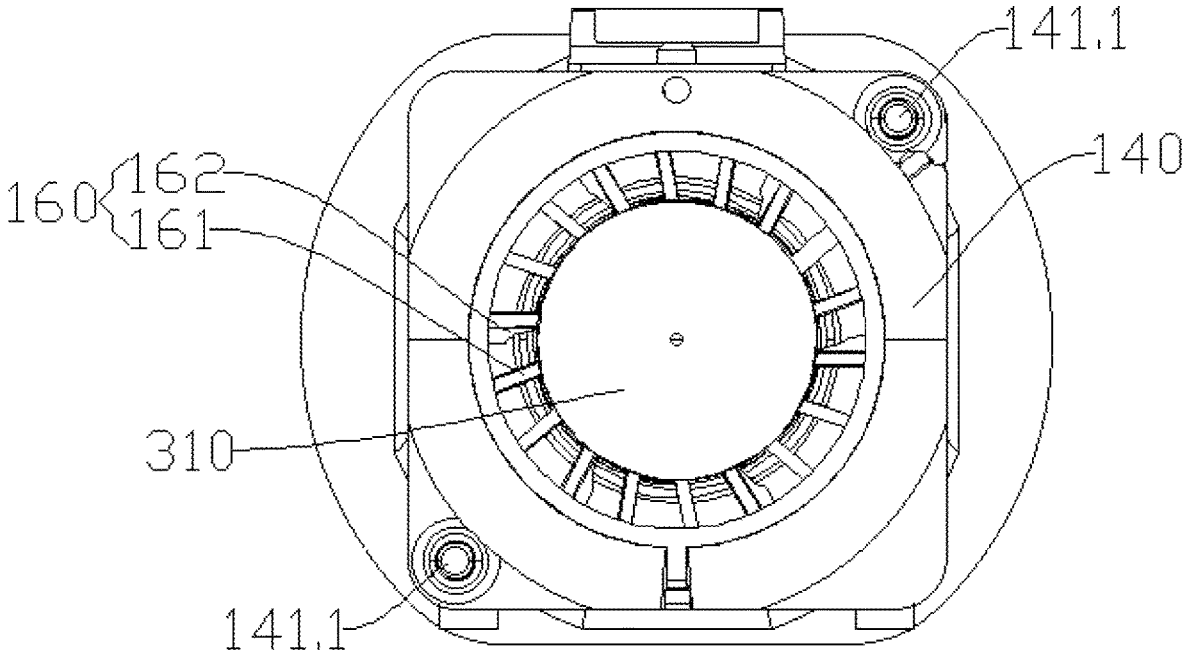
FIG. 5 is an overall rear view according to the disclosure.
Figure 6:
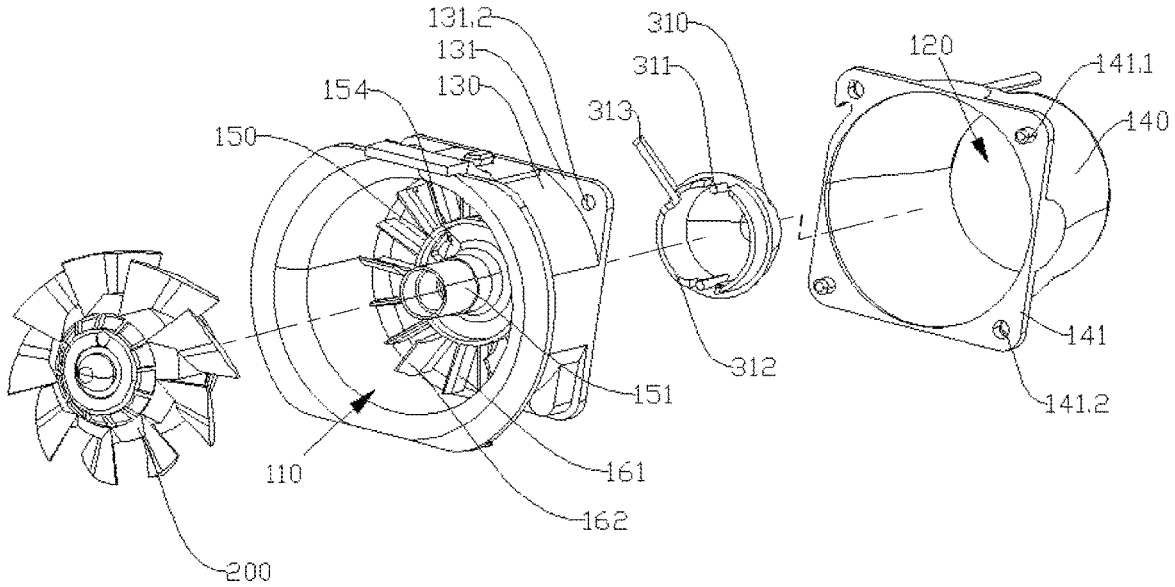
FIG. 6 is an overall exploded view according to the disclosure.
Figure 7:
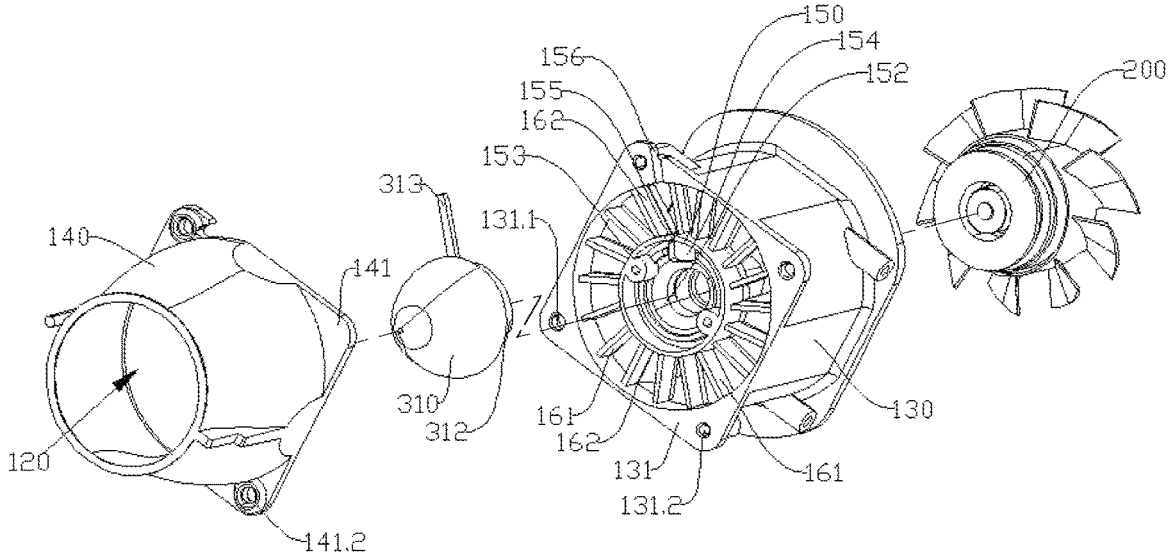
FIG. 7 is another overall exploded view according to the disclosure.
Figure 8:
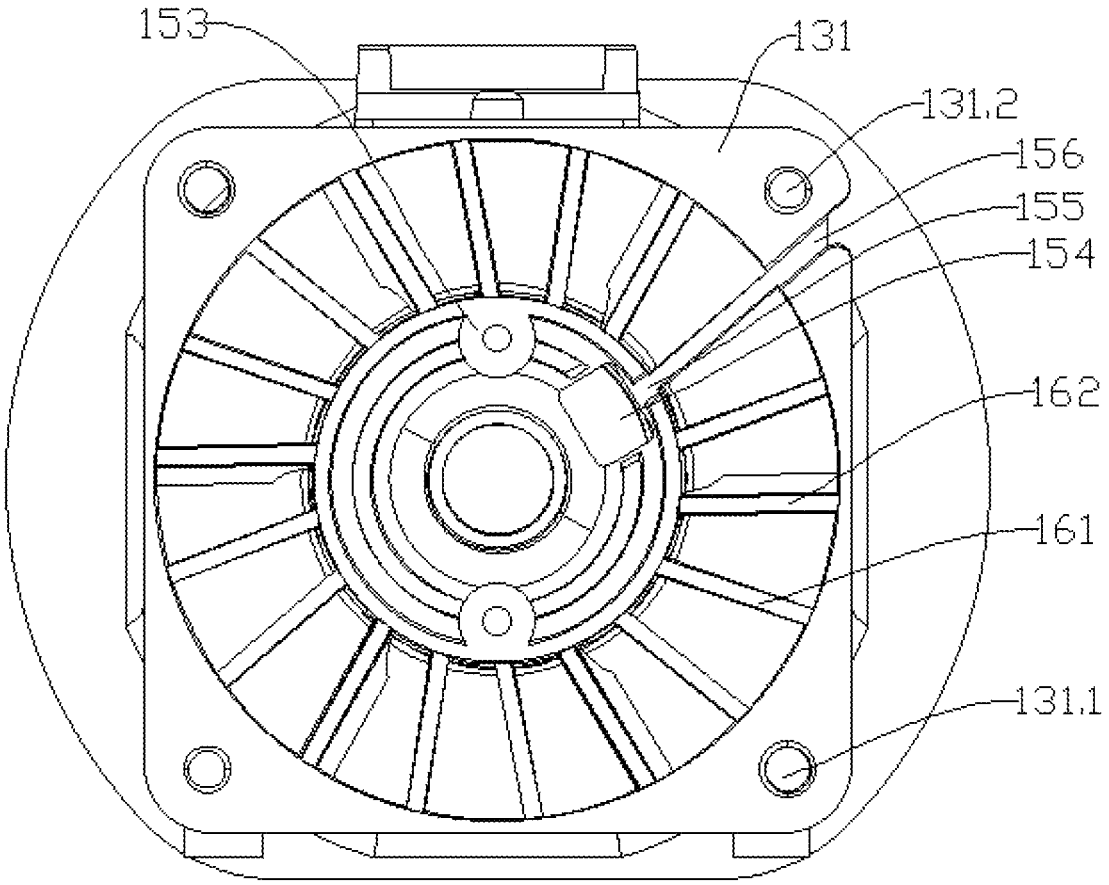
FIG. 8 is a real view of a second air duct housing according to the disclosure.

Referring to FIG. 5 to FIG. 7, in this embodiment, a first connecting plate 131 is arranged at one end of the first air duct housing 130, and a first connecting hole 131.1 and a positioning hole 131.2 are arranged at each of four corners of the first connecting plate 131; a second connecting plate 141 is arranged at one end of the second air duct housing 140 close to the first air duct housing 130, and a positioning pin 141.1 that can be plugged into the positioning hole 131.2 and a second connecting hole 141.2 matching the first connecting hole 131.1 are arranged at each of four corners of the second connecting plate 141; and connecting pieces are used to penetrate through the first connecting holes 131.1 and the second connecting holes 141.2 for secure connection. When the first air duct housing 130 needs to be assembled with the second air duct housing 140, only a positioning pin 141.1 needs to be inserted into the positioning hole 131.2, and then the connecting piece penetrates through the first connecting hole 131.1 and the second connecting hole 141.2 for secure connection. When the first air duct housing 130 needs to be detached from the second air duct housing 140, the cooperation between the connecting piece and the second connecting hole 141.2 needs to be released first, and then the positioning pin 141.1 needs to be plugged out of the positioning hole 131.2. In this embodiment, two positioning holes 131.2 are diagonally distributed on the first connecting plate 131, and two second connecting holes 141.2 are diagonally distributed on the first connecting plate 131. In this embodiment, the connecting hole is a threaded hole, and the connecting piece is a bolt.

Referring to FIG. 4 to FIG. 8, in this embodiment, a plug-in slot 152 is arranged at one end of the mounting portion 150 close to the second air duct housing 140; a hollow plug-in column 153 is arranged inside the plug-in slot 152; and an insertion column 311 configured to be inserted into the hollow plug-in column 153 for connection and an insertion block 312 configured to be inserted into the plug-in slot 152 for connection are arranged at the bottom of the deflection and boosting column 310. In this embodiment, a plurality of arc-shaped insertion blocks 312 are arranged; and the cooperation between the plug-in slot 152 and the insertion block 312 and the cooperation between the hollow plug-in column 153 and the insertion column 311 make the connection and disassembly of the deflection and boosting column 310 and the mounting portion 150 faster and easier, so that complex mounting steps and tools are not needed, and the structure of the air duct housing does not need to be damaged, thereby reducing maintenance and time costs.

Referring to FIG. 5 to FIG. 8, in this embodiment, a first wire groove 154 that is connected to one end of the mounting portion 150 away from the second air duct housing 140 is arranged at the bottom of the plug-in slot 152, a second wire groove 155 that is connected to the outer wall of the mounting portion 150 is arranged on one side of the plug-in slot 152, and a third wire groove 156 that is connected to an outer wall of the first air duct housing 130 is arranged on the inner wall of the first air duct housing 130. The arrangement of the first wire groove 154, the second wire groove 155, and the third wire groove 156 allows wires to pass through the air duct system in a more regular and orderly manner, thereby avoiding the disorderly and arbitrary placement of the wires, and improving the cleanliness and aesthetics of the system. In addition, the wire grooves can provide certain protection for wires, to prevent the wires from being damaged or worn inside the air duct system, thereby extending the service life of the wires. During use, the wires of the fan can sequentially pass through the first wire groove 154, the second wire groove 155, and the third wire groove 156 before being connected to external devices, so that the external devices can provide power supply for the fan and control the speed and the start/stop of the fan.

Referring to FIG. 5 to FIG. 8, in this embodiment, a wire pressing rod 313 is arranged at the bottom of the deflection and boosting column 310. When the deflection and boosting column 310 is mounted on the mounting portion 150, the wire pressing rod 313 is located in the second wire groove 155 and the third wire groove 156 for pressing down and fastening the wires. Further, the design of the wire pressing rod 313 can ensure that the wires are stably fastened inside the air duct system, thereby preventing the wires from shaking or falling off under the action of the air flow. This manner is more reliable than the traditional binding or pasting method, can ensure that the wires are stably connected during long-term use, and can also ensure that the wires are arranged in a more regular and orderly manner inside the air duct system, thereby reducing the crossing and winding between the wires.

Referring to FIG. 1 to FIG. 7, in this embodiment, a plurality of deflection plates 160 are arranged around the mounting portion 150, and the wire pressing rod 313 faces any one of the deflection plates 160. The wire pressing rod 313 facing the deflection plate 160 can prevent the wire pressing rod 313 from affecting the air flow inside the boosting air duct housing assembly 100, and also ensure that the wire pressing rod 313 maintains a stable connection state inside the air duct system, thereby preventing the wires from shaking and avoiding the wires from coming out of the wire groove due to shaking.

It should be understood that, for those of ordinary skill in the art, improvements or transformations may be made in accordance with the above description, and all such improvements and transformations shall fall within the protection scope of the claims attached to the disclosure.

What is claimed is:

1. A high air pressure fan, comprising:

a boosting air duct housing assembly (100), wherein two opposite ends of the boosting air duct housing assembly (100) communicate with each other and are respectively provided with an air inlet (110) and an air outlet (120);

an airflow pushing assembly (200) arranged inside the boosting air duct housing assembly (100) and configured to push air from the air inlet (110) to the air outlet (120); and a deflection and boosting assembly, comprising a deflection and boosting column (310) arranged inside the boosting air duct housing assembly (100), wherein the deflection and boosting column (310) cooperates with the boosting air duct housing assembly (100) to enable air pushed by the airflow pushing assembly (200) to be boosted inside the boosting air duct housing assembly (100);

wherein the boosting air duct housing assembly (100) comprises a first air duct housing (130) and a second air duct housing (140) detachably connected to one end of the first air duct housing (130), wherein a mounting portion (150) is arranged inside the first air duct housing (130), and an outer wall of the mounting portion (150) is connected to an inner wall of the first air duct housing (130) through a deflection plate (160);

wherein an inner diameter of the second air duct housing (140) gradually decreases from a direction of the air inlet (110) towards the air outlet (120);

wherein the deflection and boosting column (310) is arranged at one end of the mounting portion (150) close to the second air duct housing (140), and the deflection and boosting column (310) is conical and penetrates into the second air duct housing (140);

wherein the airflow pushing assembly (200) is a fan body, a fan mounting column (151) is arranged at one end of the mounting portion (150) away from the second air duct housing (140), and the fan body is rotatably connected to the fan mounting column (151);

wherein a plug-in slot (152) is arranged at one end of the mounting portion (150) close to the second air duct housing (140); a hollow plug-in column (153) is arranged inside the plug-in slot (152); and an insertion column (311) configured to be inserted into the hollow plug-in column (153) for connection and an insertion block (312) configured to be inserted into the plug-in slot (152) for connection are arranged at a bottom of the deflection and boosting column (310).

2. The high air pressure fan according to claim 1, wherein a first connecting plate (131) is arranged at one end of the first air duct housing (130), and a first connecting hole (131.1) and a positioning hole (131.2) are arranged at each of four corners of the first connecting plate (131); a second connecting plate (141) is arranged at one end of the second air duct housing (140) close to the first air duct housing (130), and a positioning pin (141.1) that can be plugged into the positioning hole (131.2) and a second connecting hole (141.2) matching the first connecting hole (131.1) are arranged at each of four corners of the second connecting plate (141); and connecting pieces are used to penetrate through the first connecting holes (131.1) and the second connecting holes (141.2) for secure connection.

3. The high air pressure fan according to claim 1, wherein a first wire groove (154) that is connected to one end of the mounting portion (150) away from the second air duct housing (140) is arranged at a bottom of the plug-in slot (152), a second wire groove (155) that is connected to the outer wall of the mounting portion (150) is arranged on one side of the plug-in slot (152), and a third wire groove (156) that is connected to an outer wall of the first air duct housing (130) is arranged on the inner wall of the first air duct housing (130).

4. The high air pressure fan according to claim 3, wherein a wire pressing rod (313) is arranged at the bottom of the deflection and boosting column (310), and when the deflection and boosting column (310) is installed on the mounting portion (150), the wire pressing rod (313) is located in the second wire groove (155) and the third wire groove (156) for pressing and fastening wires.

5. The high air pressure fan according to claim 4, wherein a plurality of deflection plates (160) are arranged around the mounting portion (150), and the wire pressing rod (313) faces any one of the plurality of deflection plates (160).

* * * * *